US005770012A

United States Patent [19]

Cooper, III

[11] Patent Number: 5,770,012

[45] **Date of Patent: *Jun. 23, 1998**

[54] PROCESS FOR TREATING PAPER MACHINE STOCK CONTAINING BLEACHED HARDWOOD PULP WITH AN ENZYME MIXTURE TO REDUCE VESSEL ELEMENT PICKING

[75] Inventor: Elwood W. Cooper, III, Dover, Pa.

[73] Assignee: P. H. Glatfelter Co., Spring Grove, Pa.

[ * ] Notice: The term of this patent shall not extend beyond the expiration date of Pat. No. 5,725,732.

[21] Appl. No.: 736,062

[22] Filed: Oct. 22, 1996

Related U.S. Application Data

[63] Continuation-in-part of Ser. No. 677,276, Jul. 9, 1996, Pat. No. 5,725,732, which is a continuation-in-part of Ser. No. 344,582, Nov. 18, 1994, abandoned.

[51] Int. Cl.[6] ..... D21H 25/02

[52] U.S. Cl. ..... 162/72; 162/134; 435/277; 435/278

[58] Field of Search ..... 162/72, 134; 435/277, 435/278

[56] References Cited

U.S. PATENT DOCUMENTS

| | | |
|---|---|---|
| 4,923,565 | 5/1990 | Fuentes et al. . |
| 5,110,412 | 5/1992 | Fuentes et al. . |
| 5,116,746 | 5/1992 | Bernier et al. . |
| 5,179,021 | 1/1993 | du Manoir et al. . |
| 5,202,249 | 4/1993 | Kluepfel et al. . |
| 5,308,449 | 5/1994 | Fuentes et al. . |
| 5,395,765 | 3/1995 | Dahlberg et al. . |
| 5,407,927 | 4/1995 | Casimir-Schenkel et al. . |

FOREIGN PATENT DOCUMENTS

| | | |
|---|---|---|
| 0351655 | 1/1990 | European Pat. Off. . |
| 0430915 | 6/1991 | European Pat. Off. . |
| 2557984 | 1/1985 | France . |
| WO 91/02839 | 3/1991 | WIPO . |

OTHER PUBLICATIONS

"Pulpzyme™ HA", (Sep. 1989), Novo–Nordisk Enzyme Process Division.

Noe, P., et al., "Action of Xylanase on Chemical Pulp Fibers",6(2), (1986), pp. 167–184.

Ishizaki, H., Tappi J., 46, No. 1, (Jan. 1992), pp. 149–155.

Uchimoto, I. et al., Jpn. J. Pap. Technol., No. 2, (Feb. 1990), pp. 1–5.

"Celluclastp® 1.5L", (Dec. 1990, Novo–Nordisk Enzyme Process Division.

"SP 476", (Mar. 1992), Novo–Nordisk Enzyme Process Division.

"Pulpzyme™ HB", Novo–Nordisk Enzyme Process Division.

"VESSELEX: Enzyme For the Paper Industry", Solvay Biosciences Pty. Ltd.

Hawley, Gessner. *The Condensed Chemical Dictionary*, 10$^{th}$ Ed., pp. 595, 870, 535.

Rogers, Allen. *Industrial Chemistry*, vol. 2, 4$^{th}$ Ed., (1926), pp. 1063 and 1064.

Tweney, C.F. and Hughes, L.E.C. *Chamber's Technical Dictionary*, 3$^{rd}$ Ed., (1959), p. 479.

Shreve, Norris R. *The Chemical Process Industries*, 2$^{nd}$ Ed., (1956), pp. 721 to 729.

Senior, D.J. and Hamilton, J. "Use of Xylanases to Decrease The Formation of AOX in Kraft Pulp Bleaching", *Journal of Pulp and Paper Science*, vol. 18, No. 5, (Sep. 1992).

O. Enso–Gutzeit. "Development of Bleaching".

*World Pulp & Paper Technology 1994*, "The International Review for the Pulp and Paper Industry", (1994), pp. 181–183.

Pedersen, L.S. et al. "Bleach Boosting of Kraft Pulp Using Alkaline Hemicellulases", (Apr. 1991).

*Primary Examiner*—Steven Alvo
*Attorney, Agent, or Firm*—Fisher,Christen&Sabol

[57] ABSTRACT

The process uses a mixture of cellulases and xylanases to chemically change the hardwood vessel elements, rendering them susceptible to breaking under normal mill refining, thus not requiring any additional refining equipment. The process involves treating bleached hardwood brownstock pulp with the cellulase/xylanase mixture. The use of a pure cellulase enzyme is excluded.

17 Claims, No Drawings

PROCESS FOR TREATING PAPER MACHINE STOCK CONTAINING BLEACHED HARDWOOD PULP WITH AN ENZYME MIXTURE TO REDUCE VESSEL ELEMENT PICKING

This is a continuation-in-part of U.S. Ser. No. 08/677,276, filed on Jul. 9, 1996, now U.S. Pat. No. 5,725,732, which is a continuation-in-part of U.S. Ser. No. 08/344,582, filed on Nov. 18, 1994, now abandoned.

BACKGROUND OF THE INVENTION

1. Field of the Invention

The invention relates to a process for treating paper machine stock containing bleached hardwood pulp with an enzyme preparation, prior to refining, to reduce vessel element picking and to improve paper printability.

2. Background Art

Hardwood pulp is used in the paper industry to produce a variety of end products. Some of these products are designed specifically for the printing and book publishing industries. The paper used in these industries has a high content of hardwood pulp which gives the paper good formation, opacity and printability. However, one problem with regard to the use of hardwood pulps results from their basic structure. Hardwoods contain two principle cell types, namely, fiber cells and vessel element cells. The non-fibrous vessel cells transport water throughout the entire tree. Consequently, they do not add strength or quality to the paper and, therefore, are not desirable. The vessel cells remain intact through the pulping, bleaching and refining processes. During the papermaking process, the vessel cells remain on the paper surface and are not bonded to the fibers. While printing, the problem is that the large unbonded vessel elements on the surface of a sheet get picked out by the printing press roll. This results in ink not being applied to all of the parts of the paper to which it was intended to be applied. The vessel cells also can remain on the roll causing voids or spots to form. The net result is that the paper is of unacceptable quality.

In the past, vessel picking problems have been addressed using sizing, coating or refining technologies. The first two approaches have been unsuccessful in fully combating this problem, and the latter approach tends to require significant amounts of capital and energy. Refining tends to be the most successful in reducing vessel picking (although high reductions have not been achieved). However, many mills are reluctant to spend the capital required to reduce this problem. Therefore, combating this problem (both tolerating and preventing it) is not only costly, but also usually goes unaddressed or accepted as normal.

Enzymes have been used in the pulp and paper industry. Xylanase enzymes have been used to improve the bleachability of kraft pulps. These enzymes attack the reprecipitated xylan and, therefore, allow better accessibility to delignify and bleach the pulp. Early work in this technology used xylanase enzyme preparations which had significant cellulase activity. These cellulases supposedly actively broke down the usable pulp fiber and reduced the fiber strength. Therefore, enzyme suppliers were heavily encouraged to remove any cellulase activity and purify the xylanases. These xylanase enzymes effectively improve the bleachability of hardwood pulp.

European Patent No. 0,351,655 discloses the treatment of an unbleached, mechanically-prepared pulp (or an unbleached, chemimechanically-prepared pulp) with a xylanase preparation which is substantially free of cellulases, to improve drainability. Cellulase was said to deteriorate the tear index.

European Patent No. 0,430,915 discloses the treatment of mechanically-prepared, softwood pulp with hydrolytic enzyme, e.g., hemicellulase, cellulase, esterase, pectinase or mixtures thereof, to modify the structure of the hemicellulose and or cellulose in the fibers so that the fibers come apart more easily during mechanical refining.

The brochure "Pulpzyme HA", apparently published in September 1989, of Novo, Enzyme Process Division, discloses Pulpzyme HA, a mixture of xylanase (500 XYU/g) and cellulase (about 300 EGU/g). The enzyme mixture is stated to be intended for use is pulping operations where a partial breakdown of the xylan structure is desirable. Page one of the brochure states: "By proper selection of process conditions (e.g., pH 6.5, 45° C.) undesirable effects of the cellulase activity may be further reduced."

The brochure "On The Use Of Pulpzyme HA For Bleach Boosting", Pedersen, L. S., (September 1989), Novo-Nordisk a/s, discloses the use of Pulpzyme HA as a pretreatment of (oxygen delignified) hardwood kraft pulp to reduce the amount of activated chlorine subsequently needed to bleach the pulp. Loss of pulp yield is said to be probably due to the cellulase content in the enzyme preparation.

U.S. Pat. No. 4,923,565 (Fuentes et al. I) discloses treating refined or recycled papermaking pulp with an enzyme preparation containing cellulases and/or hemicellulases. Xylanases are a type of hemicellulase. The enzyme treatment lowers the Schopper-Riegler (SR) degree of the pulp while maintaining the mechanical characteristics of the papers manufactured from the treated pulp. The method improves the draining of the aqueous pulp suspension. Column 2, lines 49 to 51, states that the pulp can be bleached chemical pulps for providing kraft papers. See also Examples 8 to 10. The cellulase enzyme preparations can contain a xylanase activity (column 2, lines 57 to 59). Fuentes et al. I states that the xylanase activity enables the hydrolysis of the bonding xylanases. The enzyme preparation can be at a concentration of 0.01 to 2 weight percent. The treatment is conducted at a pH of 3 to 7 and a temperature of 20° to 60° C. There is no overt mention of hardwood pulps in Fuentes et al. I, but kraft pulp can be made from hardwoods or softwoods. While column 2, lines 31 to 33, of Fuentes et al. I says that its process is not related to unrefined papermaking pulps, column 2, lines 49 to 51, says that natural or bleached chemical pulps can be used. A review of the examples (e.g., Examples 8 to 10) shows that Fuentes et al. I refines bleached pulps before enzyme treatment. Fuentes et al. I does not disclose reducing the hardwood vessel element picking of bleached hardwood pulp.

The prior art section of Fuentes et al. I refers to French Patent No. 2,557,984, which discloses treating an unrefined pulp, which has a low SR, with an enzyme solution containing xylanases.

U.S. Pat. No. 5,308,449 (Fuentes et al. II) has the same disclosure as Fuentes et al. I and is based on a line of continuing applications based on Fuentes et al. I.

U.S. Pat. No. 5,110,412 (Fuentes et al. III) discloses treating a papermaking composition of recycled fibers with an enzyme preparation to improve the machinability of the composition and the drainability of water through the fibrous layer. The enzyme preparation acts on all or part of the cellulose fiber components. The pulp is all or in part recycled fibers. The prior art section of Fuentes et al. III says that papermaking pulp of recycled fibers generally needs to be refined. Fuenes et al. III uses an enzyme preparation containing cellulases plus other enzymes. Preferably, the enzymes have a $C_1$ activity, a $C_x$ activity and a xylanase. See Examples 13 to 15, for example.

U.S. Pat. No. 5,179,021 (du Manoir et al.) discloses oxygen bleaching lignocellulosic material followed by enzymatic treatment with a substantially cellulase-free xylanase. The lignocellulosic material can be an unbleached kraft pulp. Satisfactory brightness and viscosity of bleached pulps are obtained. Example 6 of du Manoir et al. reversed the sequence with the xylanase treatment first and obtained improved brightness and viscosity.

The prior art section of du Manoir et al. states that French Patent No. 2,557,984 discloses a process for treating a hardwood bleached kraft pulp with an enzyme solution containing xylanase to reduce the amount of refining for papermaking. One xylanase required the addition of mercuric chloride to suppress the present "detrimental cellulose activity".

U.S. Pat. No. 5,395,765 (Dahlberg et al.) discloses a specific xylanase capable of hydrolyzing birchwood, oataspelt and larchwood xylans. Enzymatic treatment with the xylanases of lignocellulosic pulp improves the bleachability of the pulp.

U.S. Pat. No. 5,407,827 (Casimar-Schenkel et al.) discloses bleaching hardwood pulp with an enzyme system containing thermostatic xylanose activity. The enzyme system obtained from I. fusca acts on the hemicellulose/cellulose. The total enzyme system of I. fusca KW3 also contains cellulase. Casimar-Schenkel et al. states that supernatants of I. fusca KW3 only contain small amounts of cellulase activities (provided such does not adversely affect cellulose and the quality of the paper made therefrom.) See the table in Example 2 and column 1, lines 10 to 23. Sometimes the pulp is also chemically bleached after the enzyme treatment. Example 5 treated oxygen-bleached softwood Kraft pulp with the enzyme system and then is further bleached.

International WO 91/02839 (Pedersen et al.) discloses treating a hardwood pulp with an alkaline xylanase followed by treatment with chlorine. The cellulase activity (page 3 gives the preferred upper limit) in the alkaline xylanase preparation should be relatively low.

Noe. P., et al., "Action of Xylanases on Chemical Pulp Fibers", 6 (2), (1986), pp. 167–184, discloses treating chemical-bleached pulps with a crude enzyme mixture (including xylanases), wherein the endo-cellulases had been inhibited by $MgCl_2$. The pulp can be a kraft birch pulp. The xylans were, thereby, subjected to selective in-situ hydrolysis. It is stated that the treated pulps can be compared to slightly beaten pulps.

There are two abstracts of a Japanese article that describe the use of a cellulase enzyme to reduce the vessel picking of pulp. The abstracts mention that the treatment was especially effective on eucalyptus, which is a hardwood. The pure cellulase enzyme used in the Japanese article is marketed under the name Vesselex. Vesselex is stated to be used for the suppression of vessel pick formation. The abstracted article is Ishizaki, H., Tappi J., 46, No. 1, (January 1992), pages 149 to 155.

There is an abstract of Uchimoto. I., et al., Jpn. J. Pap. Technol., No. 2, (February 1990), pages 1 to 5, that describes the use of Vesselex (a pure Trichoderma cellulase) to treat pulp to improve vessel picking.

BROAD DESCRIPTION OF THE INVENTION

The main objective of the invention is to provide a method for treating bleached paper machine stock, which contains some percentage of bleached hardwood pulp or a mixture of bleached hardwood and softwood pulps plus any useful or conventional chemical additives, with an enzyme mixture prior to refining which will reduce vessel element picking on the paper machine (without significant pulp degradation). Other objectives and advantages of the invention are set out herein or are obvious herefrom to one skilled in the art.

The objectives and advantages of the invention are achieved by the process of the invention.

The invention treatment reduces the hardwood vessel element picking of bleached hardwood pulps used in the printing or book publishing industry. The invention process uses a mixture of cellulases and xylanases to chemically change the hardwood vessel elements, rendering them susceptible to breaking under normal mill refining. Thus, any additional refining equipment is not required.

It has been found that treating bleached hardwood pulp with an enzyme mixture containing primarily xylanase, but with significant cellulase activity, chemically effects the vessel elements so that they are more susceptible to breaking through normal mill refining.

The invention involves a process for reducing bleached hardwood vessel element picking in prepared paper machine stock containing bleached hardwood pulp, comprising said prepared paper machine stock containing bleached hardwood pulp with an enzyme mixture comprised of cellulases and xylanases in an amount of about 0.05 to about 1.0 weight percent, based on the weight of the wood fiber, dry basis, in said prepared paper machine stock, the mixture having a cellulase activity of at least 200 EGU/g, in a pH range of about 4 to about 10, at a temperature from about 85° to about 145° F. for a reaction time of about 30 to about 240 minutes at a consistency of about 1 to about 15 percent, whereby the hardwood vessel element picking in said prepared paper machine stock containing bleached hardwood pulp, which is used in the printing or book publishing industry, is substantially reduced.

As used herein, the term cellulase includes all varieties of cellulases, endo or exo, and the term xylanase includes all varieties of xylanases, endo or exo. The enzyme mixture may contain other enzymes than cellulases and xylanases. However, cellulase is not the primary component of the mixtures.

The bleached pulp is best produced from the Kraft, Sulfite, or any other commercially feasible process and bleached to a minimum of 80 percent brightness. The hardwood pulp typically is oak, maple, poplar, birch, chestnut, aspen, beech, walnut or eucalyptus or mixtures thereof.

The enzyme treatment preferably corresponds with the activity ranges of the enzymes used. The enzyme treatment is specifically effective at 0.1 percent, dry basis, on the fiber or less but can be from 1.0 percent or less. The bleached pulp is treated with the enzyme prior to refining.

The resulting paper product is any paper that ink is applied to and vessel picking will reduce the quality of the paper, such as, printing and book publishing papers. The enzyme-treated, bleached pulp can be further bleached to a brightness of 80 or greater and refined prior to the paper machine.

Bleached hardwood pulp or bleached hardwood/softwood mixture pulp or paper machine stock containing bleached hardwood pulp, are treated with an enzyme mixture, as mentioned above, in a manner that simulates the paper machine stock preparation (e.g., Valley Beaters, machine chests and storage chests) or any intermediate step following bleaching but prior to refining. The stock is at a consistency between about 1 and about 15 percent. The stock is pH adjusted to a range of about 4 to about 10, with either acid or alkali, that preferably corresponds with the optimum pH range for that specific enzyme mixture. Alkaline papermaking normally has a pH of near 7 and, therefore, an enzyme (mixture) can be used which requires no pH adjustment. The stock is held at a temperature between about 85° and about 145° F., for a reaction time of about 30 to about 240 minutes. The temperature also preferably corresponds to the optimum temperature of the specific enzymes used. When the enzyme mixture is added to the pH adjusted stock, thorough mixing should take place. After enzyme treatment, the stock is further prepared for paper machine use (i.e., dilution) for an end use in the printing and book publishing industry.

The invention enzyme treatment effectively reduces hardwood vessel picking in paper or handsheets produced from the treated stock by up to at least 70 percent. The invention enzyme treatment also improves the surface characteristics of the sheet. Various enzymes can be chosen to reduce the amount of vessel picking reduction, if desired. While the enzyme mixtures effectively reduce vessel picking, the pulp strength properties of tensile (breaking length), tear and burst are not negatively affected.

The prior art generally did not use cellulase-containing enzymes for fear of pulp degradation. The invention has the goal of substantial vessel pick reduction without significant pulp degradation. The invention excludes the use of a pure cellulase enzyme (for example, Vesselex) and the use of a xylanase which is substantially free of cellulase activity. Xylanase are hemicellulases. The concomitant use of cellulases and xylanases in the proper proportions is a core factor of the invention.

As used herein, the term "cellulase/xylanase mixture", or variations thereof, means that the enzyme mixture contains a substantial amount of cellulases, namely, at least a sufficient amount of cellulases to achieve substantial hydrolysis of the glucosidic linkages in the cellulose when the enzyme mixture is applied to aqueous, bleached cellulose pulps. Cellulase-free xylanases and xylanase-free cellulases are not within the scope of the invention process. In the cellulase/xylanase mixture, both the cellulases and the xylanases are active.

Preferably, the cellulase/xylanase mixture is obtained by natural expression from a microorganism, as opposed to a cellulase/xylanase mixture prepared by mixing the individual enzymes.

DETAILED DESCRIPTION OF THE INVENTION

The aqueous, bleached hardwood pulp slurry can, for example, be that of northern or southern hardwood. While it is preferred to employ a kraft pulp, other chemically digested pulps and mechanically-prepared pulps can be used. A bleached pulp is used. The hardwood pulp can be prepared typically in a digester in the presence of chemicals, such as, sodium hydroxide and sodium sulfide (to produce a kraft pulp) or sulfites, usually sodium or magnesium, (to produce a sulphite pulp). (Kraft pulp is often prepared by digestion with a mixture of caustic soda, sodium carbonate and sodium sulfide.) The removal of the lignin content of wood pulps is measured by a permanganate oxidation test, according to a Standard Method of the Technical Association Of The Pulp And Paper Industry (TAPPI), and is reported as a Kappa Number. The chemical pulp from the digester still contains an appreciable amount of residual lignin at this stage, and, in some cases, is suitable for making construction or packaging paper without further purification. For the manufacture of printing and book publishing papers, however, the pulp is too dark in color and must be delignified and brightened by bleaching. After the lignocellulosic material is bleached, the process of the present invention can be employed, said material sometimes referred to herein as bleached (chemical) hardwood brownstock pulp.

There are four different kinds of wood pulp: mechanical or chemimechanical pulp, sulfite pulp, sulfate or Kraft pulp, and soda pulp. The first is prepared by purely mechanical (or semi-mechanical) means, the other three by chemical means. The mechanical pulp contains all of the wood except for the bark. Chemical pulps, however, are essentially pure cellulose, the undesirable lignin and the other noncellulosic components of the wood having been dissolved away by the treatment. Because of this, chemical pulps are much superior to mechanical (or ground-wood pulp) for fine papermaking.

It has been found that treating bleached hardwood brownstock pulp with an enzyme mixture containing primarily xylanase, but with substantial cellulase activity, chemically affects the bleached vessel elements so that they are more susceptible to breaking through normal mill refining.

Prior to enzyme treatment, the pulps are fully bleached to a GE or TAPPI brightness of 80 percent or greater for use in the printing and book publishing industry. The bleached hardwood brownstock is treated with an enzyme mixture in a manner that simulates the brownstock high density storage tower. The bleached brownstock is at a consistency between 1 and 15 percent. The bleached pulp is pH adjusted (if necessary) to a range of 4 to 10, with either acid or alkali, preferably to correspond with the optimum pH range for that specific enzyme mixture. The stock is held at a temperature between 85° to 145° F. for a reaction time of 30 to 240 minutes. The temperature also corresponds to the optimum temperature of the specific enzymes used. The xylanase/cellulase mixture is used in an amount of about 0.05 to about 1.0 percent, preferably about 0.1 percent, based upon the weight of the bleach wood fiber, dry basis. The preferred xylanase/cellulase mixture is preferably Pulpzyme HA. When the enzyme mixture is added to the pH adjusted pulp, thorough mixing takes place as performed by a thick stock pump, for example. The mixture can be agitated at various speeds with the use of various mixing devices which simulate a thick stock pump. The cellulase/xylanase mixture can be applied as it is produced in a fermentation broth, or a concentrated form thereof, or as a composition prepared from either a more concentrated composition of the cellulase/xylanase mixture or a dried preparation of the cellulase/xylanase mixture. Thereafter, preferably no mixing takes place, simulating high density pulp storage and normal mill conditions. High density storage towers normally have poor or no mixing. The bleached hardwood pulp can be enzyme treated in one or more stages.

The invention enzyme treatment effectively reduces hardwood vessel picking in fully bleached hardwood pulp handsheets by up to 70 percent or more. The enzymes can be chosen so as to vary the amount of vessel picking reduction, if desired. While the enzyme mixtures effectively reduce vessel picking, the pulp strength properties of Instron tensile (breaking length), tear (Elmendorf) and burst (Mullen) have not been negatively affected.

The hardwood pulp usually is a pulp of a species of oak, maple, poplar, birch, chestnut, aspen, beech, walnut, eucalyptus or mixtures thereof.

The hardwood pulp is produced from the Kraft process, Sulfite process, or any other commercially feasible process.

Preferably, the hardwood pulp is a chemically-digested hardwood pulp, most preferably, (bleached) hardwood Kraft pulp.

The consistency of the hardwood brownstock (bleached) pulp to be treated is usually from about 1 to about 15 weight percent, preferably about 2 to about 13 weight percent, based upon the oven-dry (O.D.) weight of the pulp (bleached wood fiber).

The acid to adjust the pH of the hardwood pulp before the enzyme treatment can be any suitable inorganic or organic acid which does not have an adverse effect on the enzyme treatment of the bleached hardwood pulp. Examples of suitable inorganic acids are sulfuric acid, sulfurous acid, nitric acid, nitrous acid, phosphoric acid, phosphorous acid and mixtures thereof. The preferred inorganic acid is sulfuric acid. Chlorine-containing acids should be avoided when Pulpzyme HA is used. Examples of suitable organic acids are benzoic acid, bromoacetic acid, maleic acid, formic acid, lactic acid, malic acid, acetic acid, butyric acid, propionic acid, citric acid, oxalic acid, succinic acid, picolinic acid and mixtures thereof. The preferred organic acid is acetic acid.

The base used to adjust the pH of the hardwood pulp before the enzyme treatment can be any suitable inorganic or organic base which does not have an adverse effect on the enzyme treatment of the hardwood pulp. Examples of suitable inorganic bases are sodium hydroxide, zinc hydroxide, ammonium hydroxide, aluminum hydroxide, potassium hydroxide and mixtures thereof. The preferred inorganic base is sodium hydroxide. Examples of suitable organic bases are aniline, tripropylamine, ethylamine, propylamine, acetamide, acetanilide, diethylamine, methylamine and mixtures thereof. The preferred organic base is ethylamine.

As used herein, acids are usually defined as being substances whose molecules ionize in water solution to give the hydrogen ion(s) from their constituent elements. As used herein, bases are usually defined as being substances which ionize in water to give the hydroxyl ion(s) from their constituent elements.

Preferably an enzyme mixture is used which has an optimum pH range of 6 to 8, particularly preferred of 7 to 8.

The enzyme mixture used is a mixture of cellulase and xylanase enzymes (there must be a substantial cellulase activity). The term cellulase includes all varieties of cellulases, endo and exo. The term xylanase includes all varieties of xylanases, endo and exo. The enzyme mixture can contain enzymes other than cellulases and xylanases. However, the cellulase is not the primary component. Rather, xylanase is the primary component of the mixtures. The enzyme mixtures can be of bacterial or fungal origin. The cellulase/xylanase mixture should have a cellulase activity of at least 200 EGU/g, preferably at least 300 EGU/g, and a xylanase activity of at least 200 XYU/g, preferably at least 300 XYU/g and best at about 500 XYU/g.

The most preferred cellulase/xylanase enzyme mixture is Pulpzyme HA, which is produced by the microorganism *Trichoderma longbrachiatum*. It is a product of Novo Nordisk Bioindustrials Inc., Enzyme Process Division, of Connecticut. Pulpzyme HA is a brown liquid preparation. The Pulpzyme HA enzyme mixture contains xylanases, that is, endo-xylanase (endo-1, 4-beta-D, specifically, EC 3.2.1.8) and exo-xylanase (exo-1, 4-beta-D, specifically, EC 3.2.1.37), cellulases, that is, endo-glucanase (possibly 2 or 3 types), cellobiohydrolase (possibly 2 or 3 types) and beta-glucosidase (possibly 2 or 3 types), acetyal esterase and alpha galactosidase. The cellulase/xylanase enzyme mixture has low activity towards crystalline cellulose. One xylanase unit (XYU) is defined as the amount of enzyme which under standard conditions (pH 3.8, 30° C., 20 min. incubation) degrades larchwood xylan to reducing carbohydrates with a reducing power corresponding to 1 $\mu$mol xylose. One endo-glucanase unit (EGU) is defined as the amount of enzyme which under standard conditions (pH 6.0, 40° C., 30 min. incubation) lowers the viscosity of a carboxymethyl cellulose solution to the same extent as an enzyme standard defining 1 EGU. The Pulpzyme HA is standardized to a xylanase activity of 500 XYU/g and contains a cellulase activity of about 300 EGU/g. (A trace cellulase activity would be less than 50 EGU/g.)

While theoretically there should be little or no cellulase activity at about pH 7, the invention secured the best results at about pH 7 when using Pulpzyme HA. The preferred pH for Pulpzyme HA is about 7 to 8, although a range of 6 to 8 gives good results.

A preferred cellulase/xylanase enzyme mixture is SP 342. The multi-enzyme complex known by the designation/name SP 342 includes cellulase, glucanase, hemi-cellulase and pentosanase activities. SP 342 is a product of Novo Nordisk Bioindustrials Inc., Enzyme Process Division. SP 342 is usually in the form of a stabilized liquid preparation. A brochure says that SP 342 is active in slightly acidic to mild alkaline conditions and at moderate temperatures. FIG. 1 in the brochure shows about 100 percent relative activity in the pH range of 5 to 7.

The process uses conditions which correspond with the activity ranges of the enzymes used. The enzyme dosage is effective even at 0.5 weight percent, based on the dry bleached fiber.

The bleached hardwood pulp is treated with the enzyme prior to refining. The enzyme can be inhibited after the treatment, by heating the pulp to a sufficient temperature or by adding an acid or base to change the pH to an inhibition value, at the end of the time period for the cellulase/xylanase treatment, the resultant treated material can either be used directly or thickened, and the treated material, then, can be used for further processing.

The pulp is bleached to a GE or TAPPI brightness of 80 or greater prior to the enzyme treatment, the refinement and the paper machine. The pulp is subsequently treated in various ways, depending upon the type of paper desired.

Before the enzyme treatment, the conventional method for further delignifying and bleaching pulp can be to employ a variety of multi-stage bleaching sequences, including anywhere from three to six stages or steps, with or without washing between steps. The objective in bleaching is to provide a pulp, in the case of chemical pulps, of sufficiently high brightness and strength for the manufacture of paper and tissue products. Characteristically, pulps of GE or TAPPI brightness of 80 to 86 percent are produced. The bleaching sequences can be based on the use of chlorine and chlorine-containing compounds, in one form or another. Some of the chlorine-containing compounds that are used are chlorine, chlorine dioxide, and hypochlorites, usually, sodium hypochlorite. Chlorine, with or without admixture of chlorine dioxide, is commonly employed to initiate the bleaching or chemical pulp, followed by extraction of the chlorine-treated pulp in an aqueous alkaline medium. Also, oxygen can be used as the delignifying and bleaching agent. One application is the use of oxygen in conjunction with a conventional alkaline extraction stage.

If chlorine or a chlorine-containing compound is used, it is best to remove, e.g., water washing, as much of the residual chlorine or chlorine-containing compound as possible before using Pulpzyme HA as the enzyme agent because Pulpzyme HA is chlorine sensitive.

The resultant paper product is any paper which ink is applied to and which vessel picking will reduce the quality of the paper, such as, printing and book publishing papers.

Vesselex is a liquid cellulase preparation standardized at 100 U/g FPase which is marketed by Solvay Biosciences Pty. Ltd., Victoria, Australia. When hardwood pulp (Eucalyptus) is used as the raw material for the manufacture of paper, the vessels which remain in the paper cannot properly accept the ink during printing, and the ink at the site of the vessels comes off causing the vessel pick phenomena. Solvay Biosciences asserts that Vesselex is a cellulase enzyme which has been specially developed to reduce the formation of vessel picks in paper manufactured from hardwood pulp. The process of using Vesselex in the paper industry uses pulp thickening and then, before bleaching, enzyme (from an enzyme holding tank at 5° C.) added to white water which is fed to a static mixer and the mixture is then added to a pulp chest which is sent to a refinery. The stated conditions were: pulp concentration, 5 to 6 percent; pH, 5.0 to 5.5; enzyme dose, 0.02 to 0.03 percent (w/w); temperature, 30° to 40° C.; and reaction time, not less than 4 hours. Regarding the prevention of vessel pick formulation by Vesselex cellulase: at an enzyme dosage of zero percent (w/w), the vessel picks were 185 (count per 10 sqr. cms.); at an enzyme dosage of 0.1 percent, the vessel picks were 18; and at an enzyme dosage of 0.2 percent, the vessel picks were 22. It is reported that, as the Vesselex cellulase dosage increases, the pulp degradation increases, but at the ideal dosage of 0.03 to 0.05 percent, there is almost no pulp loss. It is also reported that the Vesselex cellulase is completely inactivated in one minute under normal machine drying conditions at 120° C.

Vesselex is used for the prevention of vessel pick formation before bleaching. However, the invention is different, for example, because of different conditions: pH (5.0 to 5.5, Vesselex vs. pH 4 to 10, invention), temperature (30° to 40° C., Vesselex vs. 85° to 145° F., invention), reaction time (4 hours, Vesselex vs. 0.5 to 4 hours, invention), and pulp concentration (5 to 6 percent, Vesselex vs. 1 to 15 percent, invention). Most importantly, cellulase use can prove detrimental for paper properties other than vessel picking, and, thus, its use should be minimized. The disclosed discovery allows for the beneficial end product of vessel picking by using decreased levels of cellulase activity, and, thus, reducing the detrimental effects of cellulase use. Also, the invention process treats bleached hardwood pulp.

EXAMPLE 1

Laboratory work was conducted on stock collected from a Valley Beater in a mill stock preparation area. The stock contained approximately 78 percent of bleached hardwood pulp by weight. After processing this stock, it will ultimately be used in making paper that will be printed. 80 oven dry (O.D.) grams of stock were used. 0.10 percent of Pulpzyme HA (manufactured by Novo Nordisk, this product is a mixture of xylanase and cellulase enzymes) by weight on hardwood fiber was applied to the stock. The stock/enzyme mixture was mixed on a ball mill for 5 hours at a starting temperature of 115° F. After the reaction, the stock was treated with sulfuric acid to denature the enzyme. Then, the stock was made into TAPPI standard handsheets. This same experiment was repeated with 0.16 percent and 0.08 percent of Pulpzyme HA. A control was also performed using the same conditions without any Pulpzyme HA. The handsheets were analyzed for IGT vessel picking. The following Table 1 sets out the bleached hardwood vessel pick results. The average results are of four IGT vessel pick tests.

TABLE 1

| Pulpzyme HA, percent | Vessel Picking/cm$^2$ |
|---|---|
| 0 | 4 |
| 0.10 | 0 |
| 0.16 | 0 |
| 0.08 | 0 |

Another observation was made regarding surface appearance. The handsheets were examined for surface appearance and fiber protrusion. Fiber protrusion may indicate a deteriorated fiber or a weakened, poor bonding fiber. Fiber protrusions may ultimately result in fiber picking, and, thus reduced print quality. The enzyme treated sheets had 80 percent fewer fiber protrusions than did the control sheets. The enzyme treated sheets also appeared to have a better bonded surface, appearing to be smoother and more uniform than the control sheets.

EXAMPLE 2

This work was done in a mill trial using Pulpzyme HA addition to a Valley Beater, prior to refining and papermaking. The grade of paper furnish used was a printable grade. The enzyme was added directly to the beater charged with the furnish. The enzyme was added at a dosage of 1 kg/ton of hardwood pulp (0.11% w/w). The retention time in the system was a minimum of 3 hours before the paper machine. The temperature in the beater was 115° F. and the pH was 7.2. There was a control phase, followed by an enzyme phase, followed by another control phase. The level of the machine chest just prior to the paper machine was lowered between phases to ensure a good break. Paper samples were collected from the reel and tested for IGT vessel picking. Six different samples in duplicate were evaluated for IGT vessel picking from the pre-enzyme control period, eight in duplicate from the enzyme period, and eight in duplicate from the post-enzyme control period. The IGT results are as follows:

TABLE 2

| | |
|---|---|
| Pre-control: 4, 6, 4, 4, 5, 6, 5, 5, 4, 4, 6, 5/cm$^2$ | Avg = 5/cm$^2$ |
| Enzyme: 1, 1, 0, 1, 0, 0, 1, 0, 0, 1, 0, 1, 0, 1, 2, 0/cm$^2$ | Avg = 1/cm$^2$ |
| Post-control: 4, 4, 4, 4, 4, 4, 4, 5, 5, 6, 6, 5, 4, 5, 4, 5/cm$^2$ | Avg = 5/cm$^2$ |

The same observations in surface appearance which were made in Example 1 were also true in Example 2.

The Pulpzyme HA mill trial reinforced the results of the laboratory vessel pick reduction study.

What is claimed is:

1. A process for reducing bleached hardwood vessel element picking in prepared paper machine stock containing bleached hardwood pulp, comprising traeting prepared paper machine stock containing bleached hardwood pulp with an enzyme mixture comprised of cellulases and xylanases in an amount of about 0.05 to about 1.0 weight percent, based on the weight of the wood fiber, dry basis, in said prepared paper machine stock, the mixture having a cellulase activity of at least 200 EGU/g, in a pH range of 7 to 8, at a temperature from about 85° to about 145° F. for a reaction time of about 30 to about 240 minutes, at a consistency of about 1 to about 15 percent, whereby the hardwood vessel element in said prepared paper machine stock containing bleached hardwood pulp, which is used in the printing or book publishing industry, is substantially reduced.

2. The process as claimed in claim 1 wherein the cellulase/xylanase mixture has a cellulase activity of at least 300 EGU/g.

3. The process as claimed in claim 1 wherein the cellulase/xylanase mixture is produced by *Trichoderma longibrachiatum.*

4. The process as claimed in claim 1, wherein the conditions correspond with the activity ranges of the enzymes used.

5. The process as claimed in claim 1, wherein the bleached hardwood pulp is prepared by a chemical pulpins process and then bleached to a minimum of 80 percent brightness.

6. The process as claimed in claim 1, wherein the pulp is a hardwood species selected from the group consisting of oak, maple, poplar, birch, chestnut, aspen, beech, walnut, eucalyptus and mixtures thereof.

7. The process as claimed in claim 1, in which the resulting paper product is a paper that ink is applied to and vessel picking will reduce the quality of the paper.

8. The process as claimed in claim 1, wherein the enzyme mixture contains substantial amounts of both xylanases and cellulases.

9. The process as claimed in claim 1, wherein the bleached pulp is unrefined before it is treated with the enzyme mixture.

10. The process as claimed in claim 1, wherein the bleached pulp is refined after it is treated with the enzyme mixture, and prior to paper formation in a paper forming machine.

11. The process as claimed in claim 1, wherein the cellulase/xylanase mixture has a xylanase activity of at least 300 XYU/g.

12. The process as claimed in claim 1, wherein the xylanases are from the group consisting of endo-xylanases and exo-xylanases.

13. The process as claimed in claim 1, wherein the cellulases are from the group consisting of endo-cellulases and exo-cellulases.

14. The process as claimed in claim 1, wherein the xylanases are from the group consisting of endo-1,4-beta-D-xylanase and exo-1,4-beta-D-xylanase.

15. The process as claimed in claim 1, wherein the cellulases are selected from the group consisting of endo-glucanase, cellobiohydrolase, beta-glucosidase, acetyl esterase, pentosanase, and alpha-galactosidase.

16. The process as claimed in claim 1, wherein the process reduces the hardwood vessel element picking in handsheets made from the pulp by 30 to 100 percent.

17. The process as claimed in claim 1, wherein the process reduces the hardwood vessel element picking in handsheets made from the pulp by at least seventy percent.

* * * * *